United States Patent [19]

Williamson, Jr.

[11] 4,154,031

[45] May 15, 1979

[54] VAULT

[76] Inventor: Mims Williamson, Jr., 2102 Cherrycove Ct., Maryland Heights, Mo. 63042

[21] Appl. No.: 869,787

[22] Filed: Jan. 16, 1978

[51] Int. Cl.[2] ..... E04H 13/00

[52] U.S. Cl. ..... 52/100; 27/35; 52/124; 52/138

[58] Field of Search ..... 52/138, 139, 142, 124, 52/135, 100; 27/35

[56] References Cited

U.S. PATENT DOCUMENTS

| | | | |
|---|---|---|---|
| Re. 29,114 | 1/1977 | McQuestion | 52/135 X |
| 135,006 | 1/1873 | Ober | 52/139 |
| 852,080 | 4/1907 | Russell | 52/124 |
| 1,883,600 | 10/1932 | Daniels | 52/138 X |
| 1,920,101 | 7/1933 | Nagel | 52/142 |
| 2,940,156 | 6/1960 | Cook | 27/35 |
| 3,208,188 | 9/1965 | Fulton et al. | 52/138 |

*Primary Examiner*—Alfred C. Perham
*Attorney, Agent, or Firm*—Paul M. Denk

[57] ABSTRACT

A burial vault having a base of rather planar configuration, a dome like portion extending thereabove, and capable of securing with the base by means of a seat provided around the periphery of the said base that accommodates the lower continuous edge of the said dome portion; the base is provided with a pair of recesses that provide clearance for the location of the straps or other instrumentality as used during the handling and descent of the burial vault, with the dome portion of the vault having internal reinforcement, either in the form of integral ribs, or embedded rods, or a combination of each, so as to rigidify the dome and enhance its load supporting strength during usage.

8 Claims, 6 Drawing Figures

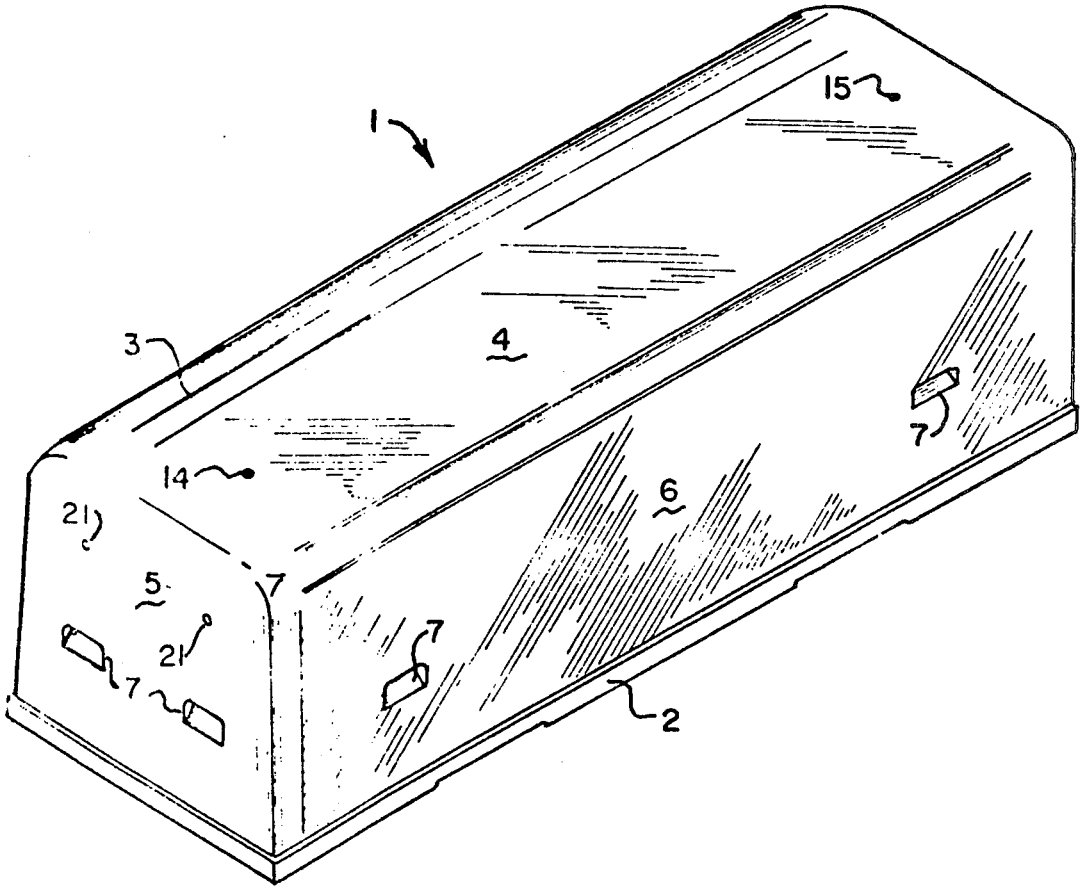

VAULT

BACKGROUND OF THE INVENTION

This invention relates generally to a burial vault, but more specifically pertains to a dome configured base supported vault that is reinforced for providing enhanced load supporting strength during usage.

A variety of burial vaults have been provided in the prior art, and the most widespread vault is of the concrete type that is designed for holding a casket, generally for preserving the same, as when used in the undertaking art. The continued usage of such a vault, this day and age, is believed to be a product of mere tradition, since such vaults are most often constructed of heavy cast concrete, have enormous weight, are pervious to some moisture penetration, and in general, are highly expensive in cost and handling. But, the concept of constructing vaults of other materials is slowly being approached, and as can be seen in the United States patent to McQuestion, U.S. Pat. No. Re. 29,114, there is shown one design for a burial vault being formed from a fiberglass resin composition. While the concept of the resin vault as shown in this prior patent provides what would appear to be an improvement over the prior art style of vault, the one concern with its structure is the fact that it is formed having the same configuration as the earlier style vaults, and therefore, is difficult to handle due to the much lesser rigidity inherent in any such vault constructed of a resinous material that yet must accommodate other significant weight, such as the cadaver and its enclosing casket.

The current invention is designed as a two piece burial vault of a special configuration that is designed to enhance its load supporting characteristics, and at the same time greatly facilitate its handling over what is presented in the prior art. It is, therefore, the principal object of this invention to provide a burial vault that is formed of a dome configuration and constructed of molded thermosetting polymer sufficiently reinforced to enhance its strength not only during usage, but in supporting a supplemental load, such as the heavy earth, when embedded within the soil.

A further object of this invention is to provide a polymer formed burial vault constructed of only two components, namely, a substantially planar base upon which a domed portion seats.

A further object of this invention is to provide a dome shaped burial casket that is fully reinforced with a combination of integral ribs and/or reinforcement rods or bars that are arranged transversely or even longitudinally of the dome portion in order to enhance its structural strength.

A further object of this invention is to provide a dome configured burial vault constructed of a reinforced polymer and therefore being of much lesser weight than any of the prior art style of marketed burial vaults.

Another object of this invention is to provide a burial vault that may be injection molded in a minimum of time thereby lending itself very well to mass production.

A further object of this invention is to provide a burial vault that is configured having tapered contours that enhances the stackability of the vault components thereby requiring only a minimum of space during shipment and storage.

These and other objects will become more apparent to those skilled in the art upon reviewing the summary of this invention, and upon undertaking a study of its preferred embodiment in view of the drawings.

SUMMARY OF THE INVENTION

This invention contemplates the formation of a burial vault by the injection molding process from any of the available variety of preferably thermosetting polymer materials. The invention comprises an exterior form of a burial vault which can readily accommodate the standard casket, and greatly facilitates the entrance of the casket into its final confines because the base of the vault is designed having a rather planar configuration, without walls, and therefore the casket need only be set upon the base, as when it has been erected over the site of its eventual embedment within the ground. The base is intended to have set upon it a dome like portion, also injection molded from a polymeric material, which setting can be easily performed by one or a couple of workmen due to its lightness of weight because of its construction of this type of material.

The burial vault of this invention is intended to replace the presently available concrete, steel, or wood type of vaults now in vogue, as have been used for years, and in doing so provide a vault which is exceedingly light in weight, virtually indestructable, will not decay, and in addition may remain substantially air tight, if desirable, and perfectly waterproof. The vault is generally formed, as previously explained, from a polymer, preferably a molded thermosetting, or even thermoplastic material, such as a polyethylene, or perhaps polypropylene, polystyrene, polyurethane, or any similar type of plastic as generally used in the injection molding art. The weight of the unit will be in the vicinity of only 100 to 120 pounds, which presents a significant weight reduction over the type of concrete vaults presently being used in the mortuary trade. In addition, the burial vault of this invention, when constructed, as for example, from polyethylene, and to the specifications of this design, is sufficiently rigid to withstand high surface pressures, mainly due to the inherent and integrally formed ribs provided within the dome portion of the vault, and as yet further reinforced through the usage of rods or bars, such as of noncorroding aluminum, that may be embedded within the dome portion of the vault during its injection molding, or even subsequently applied by means of an adhesive, or other means of fastening, to the interior surface of the dome during its fabrication. Through analysis, the burial vault of this invention has been designed to withstand a soil density of eighty pounds per cubic foot, and to withstand an impact force of over 5000 pounds, as for example when a vehicle of some sort may be driven on ground over the grave site. In addition, the burial vault of this invention is further reinforced to the extent that four such vaults may be arranged vertically upon one another within the grave site, which is a means for burial becoming more desirable this day due to the lack of ground sites available for cemetery usage especially near the urban areas.

The burial vault of this invention is further designed to facilitate and make more easily its manual handling, thereby reducing the number of laborers required at the grave site, and thereby significantly reduces the cost of a burial, which as is well known can be of rather significant costs. For example, the planar base portion of this burial vault contains at least a pair of recesses formed along its bottom surface, generally transverse of the same, so that the straps usually employed for lowering the casket and its vault within the grave can be readily removed after the vault comes to rest upon the bottom of the dug site. Furthermore, and if desirable, knock out plugs are provided within the domed portion of the vault as when it may be desirable to allow the admittance of air into the vault just prior to its covering with earth. In addition, and where it may be desirable to maintain a sealed closure for the vault, the knock out plugs can be allowed to remain in tact, and a sealing gasket may be provided around the seat formed of the periphery of the base of the vault, so that when the continuous lower edge of the dome portion is brought into engagement within the base seat, there may be provided a sealed and adhering engagement between these two components.

DESCRIPTION OF THE PREFERRED EMBODIMENT

Figure 1:
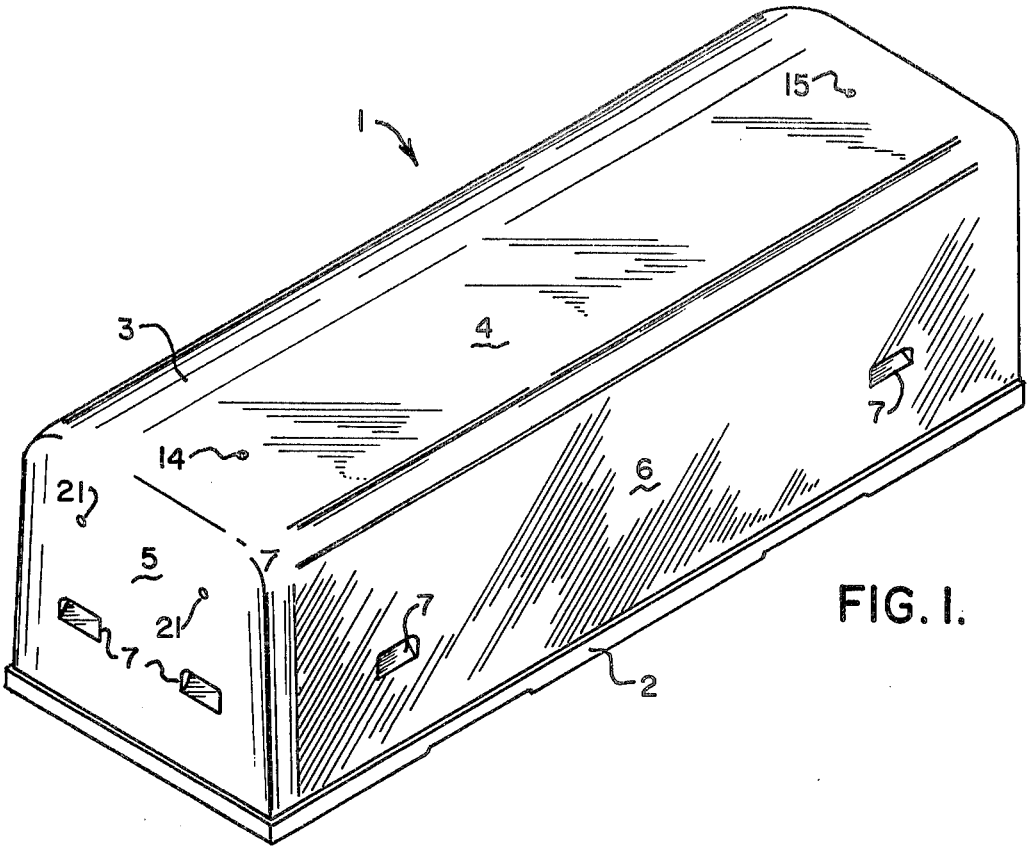
FIG. 1 discloses an isometric view of the burial vault of this invention.

In referring to the drawings, and more particularly FIG. 1, there is disclosed the vault 1 of this invention, comprising a base 2, designed for seating its domed portion 3 thereupon. The domed portion has an upper or top wall 4 which is integrally molded with the downwardly depending end and side walls 5 and 6, respectively. Also further integrally molded into these walls are the inwardly extending notches as at 7, and which are provided for facilitating a grasping and carrying of at least the dome portion 4 of the vault.

Figure 2:
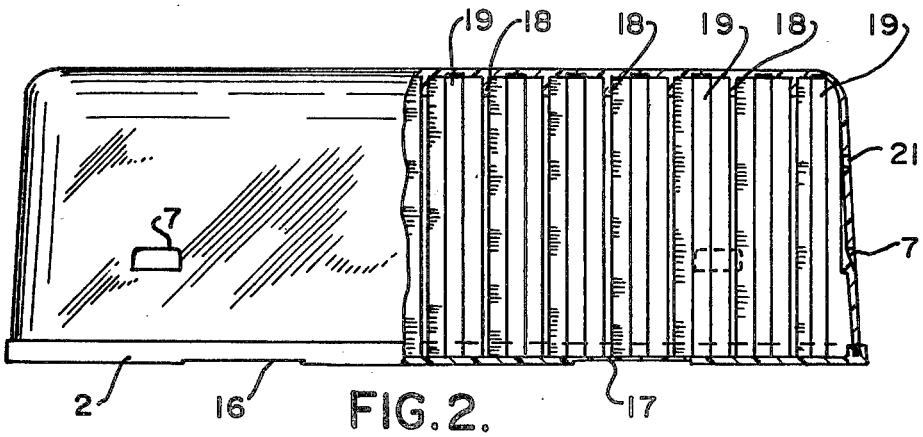
FIG. 2 provides a side view of the burial vault, with a partial section provided for disclosing the reinforced interior of its dome portion.
Figure 3:
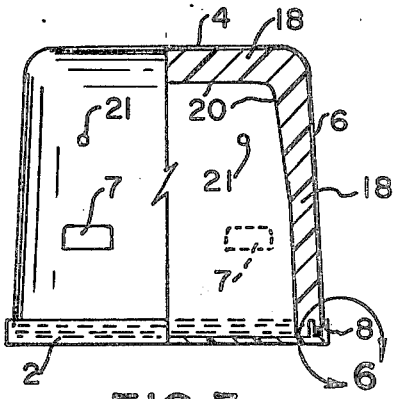
FIG. 3 provides an end view of the burial vault, with a partial section being provided for disclosing, once again, the reinforcement provided within its dome portion.
Figure 6:
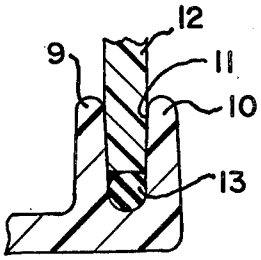
FIG. 6 furnishes a corner sectional view of the lower edge of the dome portion located by means of a sealing gasket within the seat provided at the periphery of its base.

As can also be seen in FIGS. 2 and 3, the burial vault, and more specifically its base 2, is of a rather planar configuration, and therefore facilitates its arrangement for support of the coffin as during the funeral ceremonies sometimes conducted at graveside. But, the base is provided with a seat, as at 8, entirely around its periphery, and as can further be seen in FIG. 6, the seat is formed of concentric lips 9 and 10 that project slightly upwardly, leaving a space, as at 11, therebetween, and which provides the seat in which the lower edge, as at 12, of the walls 5 and 6 of the dome portion 3 may insert during a final closure of the vault, as when it is prepared for lowering into the grave.

It may further be noted that the seat 8 of the base may also, if desired, although not necessarily, have a sealing gasket, such as of an epoxy or other adhesive, located therein, before the lower edge 12 of the dome portion is inserted therein, so as to provide a complete and hermetic seal of the vault for usage. On the other hand, it may not be desirable, under many circumstances, to completely seal the vault, and therefore, no such sealing gasket 13 may be located within the seat, and in addition, knock out plugs, as at 14 and 15, may be punched from their location within the molded dome and thereby provide apertures through which atmosphere may permeate into the vault, before it is buried. Also, knock out plugs 21 may be furnished in the walls 5, and similar plugs 22 may be provided through the base 2, for the same utilitarian purpose.

Figure 4:
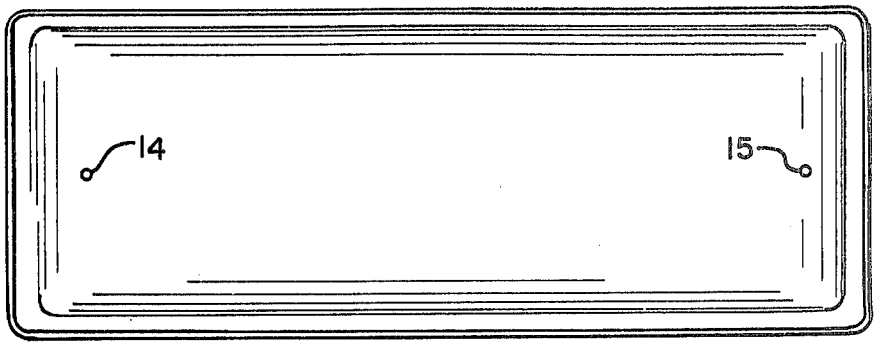
FIG. 4 furnishes a top plan view of the burial vault of this invention, with its dome portion being seated upon its base.
Figure 5:
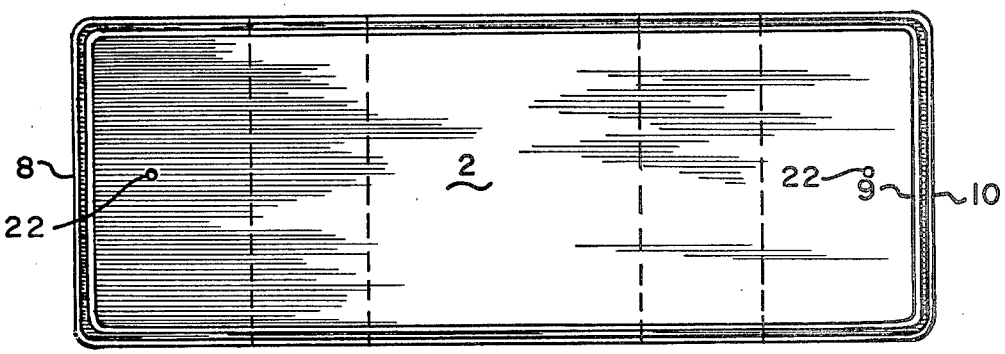
FIG. 5 discloses a top plan view of just the base of the burial vault of this invention.

As can also be seen from FIG. 4, the entire vault may have a rather rectangular configuration, and is generally designed to that size sufficient to accommodate the insertion and retention of a casket therein. Obviously, other shapes may be provided for the vault other than that as specifically shown in FIG. 4, which is set forth for illustrative purposes. And, as can further be seen clearly in FIG. 5, the seat 8 is formed of the inner and outer concentric lips 9 and 10, respectively, fully surrounding the entire periphery of the base 2 of the vault.

It can also be noted with respect to the base, as in FIG. 2, that a pair of recesses 16 and 17 are formed into the underside of the base 2, extend the full transverse width of the same, and thereby provide a location where the straps for lowering of the vault into the grave may be positioned, with the depth of each recess desirably being slightly greater than the thickness of a strap, so that when the vault is lowered into position within the grave, there will be sufficient clearance for the straps to be pulled free from under the base thereby leaving just the vault properly positioned for burial.

Of further significance in this invention is the properly positioned reinforcement provided specifically for the dome portion of the burial vault. As can be seen in FIGS. 2 and 3, a series of transversely arranged integral ribs 18 are provided across the interior of the top wall 4 of the dome, and in addition, these reinforcing ribs extend downwardly also upon the interior surface of the side walls 6 of the vault. Such reinforcement is intend to enhance the load capacity of particularly the dome portion of the vault, and these ribs, in the preferred design, are spaced approximately 6 inches, more or less, apart. And, these ribs are generally two inches in depth, and approximately $\frac{5}{8}$ inch in thickness, in the preferred design. But, to enhance the load supporting characteristics of the portion 3, the ribs 18, at the upper locations, as at 20, may be greater in depth in order to further reinforce the said portion at this location. Obviously, other dimensions for these ribs may be designed into the structure of this invention in order to enhance, or lessen, the load supporting strength of the vault, and more specifically of its dome portion. To further supplement and enhance the load support of this vault, reinforcing rods, as at 19, may be provided also upon the interior surface of the side walls and top wall of the dome, and either be surface mounted, or embedded therein during the injection molding process and within proximity of the interior surface of the said dome portion 3. And, these reinforcing rods or bars 19 are spaced approximately equally distant between adjacent ribs 18, and therefore further enhance the strength withstanding abilities of the burial vault. In the preferred embodiment, these reinforcing means, namely, the ribs 18, and the bars 19, have been designed to those sizes and spacing within the structure to accommodate a soil density of approximately 80 pounds per cubic foot, as aforesaid, to withstand an impacting load, such as exerted by a vehicle, in the vicinity of a point load of 4500 pounds, and to withstand a live load in the vicinity of 9000 pounds, all which translates into a total load, both of soil weight and impacting forces, in the range of 630 pounds per square foot. This is the design provided for the preferred embodiment, although obviously, the reinforcing members of this invention may be varied, so as to further enhance, or lessen, as previously stated, the load supporting strength of the vault.

It can further be seen from FIGS. 2 and 3 that the end walls 5 and the side wall 6 of the dome are slightly tapered downwardly, and in this manner, facilitates the convenience of the injection molding process in forming the dome 3 as a one piece item, but at the same time, and due to this tapering feature, a plurality of these domes may be nested together to minimize space requirements when they are either transported or stored, as before usage. In addition, since the base 2 of the vault is of a planar configuration, they may be simply stacked one upon the other for the convenience of storage or transit.

Variations in the design of this invention may occur to those skilled in the art upon reviewing the subject matter of this invention. Any such modifications, if within the spirit of this invention, are intended to be encompassed by any claims issuing upon this invention in any patent. The preferred embodiment, as previously explained, is set forth for illustrative purposes only.

Having thus described the invention what is claimed and desired to be secured by Letters Patent is:

1. A burial vault for use in supporting a casket as when positioned in the ground comprising a base, said base being substantially planar in configuration, a dome portion, said dome portion having integral end and side walls and connected by an integral top wall, said side and end walls of the dome portion being tapered, thereby facilitating the stacking of a plurality of dome portions upon each other, said base around its periphery forming a seat, said end and side walls having a continuous lower edge, said edge being accommodated by the base seat when the vault is closed in preparation for its usage, said dome portion including reinforcement to enhance its load supporting strength, said reinforcement including a series of solid reinforcing ribs integrally formed interiorly of the said dome portion, said reinforcing ribs extending transversely of the said dome portion, with said reinforcing ribs extending transversely across the interior of the top wall and extending integrally down the entire side walls, said reinforcement also including metallic rods associated with the molded dome portion, said rods being embedded within the said molded dome portion and extending across its top wall and down its side walls, said rods being arranged spaced approximately equally distant intermediate the aforesaid transversely arranged reinforcing ribs, and said burial vault being formed of a molded thermosetting polymer.

2. The invention of claim 1 wherein said base seat includes a pair of concentrically arranged inner and outer lips around its periphery, with the dome lower edge being accommodated between the said seat lips.

3. The invention of claim 2 and including at least one recess formed upon the underside of the base for providing clearance for removal of any instrumentality used during handling of the burial vault.

4. The invention of claim 3 and including a gasket provided within the base seat and facilitating its sealing and adherence during application of the burial vault dome portion.

5. The invention of claim 1 and further including hand gripping means provided spacedly at least around a pair of said end and side walls.

6. The invention of claim 1 and further including at least one aperture provided within the dome portion of the burial vault, and said aperture containing a knock out plug which when removed provides for the entrance of air into the burial vault.

7. The invention of claim 1 and including at least one aperture provided within the base of the vault, and said aperture containing a knock out plug which when removed provides for the entrance of air into the burial vault.

8. The invention of claim 1 wherein said ribs are of greater depth at their location within the upper portion of the dome than at its lower portion.

* * * * *